US005607161A

United States Patent [19]

Skratulia

[11] Patent Number: 5,607,161

[45] **Date of Patent: *Mar. 4, 1997**

[54] METHOD OF PLAYING AN IMPROVED VERSION OF THE GAME OF PAI GOW POKER

[76] Inventor: John Skratulia, 11402 Howard St., Whittier, Calif. 90601

[ * ] Notice: The term of this patent shall not extend beyond the expiration date of Pat. No. 5,452,900.

[21] Appl. No.: 500,337

[22] Filed: Jul. 10, 1995

[51] Int. Cl.[6] ..... A63F 1/00

[52] U.S. Cl. ..... 273/292; 273/274

[58] Field of Search ..... 273/146, 138 R, 273/268, 274, 292, 309

[56] References Cited

U.S. PATENT DOCUMENTS

| | | | |
|---|---|---|---|
| 4,743,025 | 5/1988 | Gramera | 273/146 |
| 5,248,142 | 9/1993 | Breeding | 273/274 |
| 5,249,809 | 10/1993 | Wolf | 273/274 |
| 5,314,194 | 5/1994 | Wolf | 273/274 |

FOREIGN PATENT DOCUMENTS

| | | | |
|---|---|---|---|
| 510065 | 2/1955 | Canada | 273/146 |

OTHER PUBLICATIONS

WIN Magazine, Pai Gow Poker, pp. 39, 40 and 70 Apr. 1992.

*Primary Examiner*—William M. Pierce
*Attorney, Agent, or Firm*—Timothy T. Tyson; Ted Masters

[57] ABSTRACT

A method of playing an improved version of the game of Pai Gow Poker also known as Asian Poker wherein a fifty six card playing deck includes a fifty two card standard deck plus four jokers, thereby permitting as many as eight players to participate in the game. A set of three special dice 48, 54, and 60 is utilized to determine an action player, and may also be utilized to determine the direction of sequential play. In an improved banking method, the bank hand (player-banker) is not fixed for each hand (deal), but the bank hand can move from player to player during the play of the game depending upon which player has the better hand.

18 Claims, 8 Drawing Sheets

TO FIG. 11 CONT STEP 213

METHOD OF PLAYING AN IMPROVED VERSION OF THE GAME OF PAI GOW POKER

TECHNICAL FIELD

The present invention pertains generally to wagering games and more particularly to a method of playing an improved version of the game of Pai Gow Poker also known as Asian Poker.

BACKGROUND ART

The present invention constitutes an improved version of the game of Pai Gow Poker. Sources well known in the art of Pai Gow Poker include Mason Malmuth, "The Gambling Theory and Other Topics" (Las Vegas: Mason Malmuth, © 1990); Bill Zender, "Pai Gow Poker" (Las Vegas: Bill Zender, © 1991); Stanford Wong, "Optimal Strategy for Pai Gow Poker" (La Jolla: Pi Yee Press © 1992); George Allen, "How to Play Pai Gow Poker" (Tempe: George Allen, © 1988); and Mike Caro, "Caro's Professional Pai Gow Poker Report and Banker Guidelines" (Las Vegas: Mike Caro, © 1986).

DISCLOSURE OF INVENTION

The present invention is directed to a method of playing an improved version of the game of Pai Gow Poker also known as Asian Poker. The improved method comprises several new features which can be used singularly or in various combinations to enhance the play of the existing game. One suggested name for the present invention is Pai Gow Jokers.

In accordance with a preferred embodiment of the invention, a fifty six card playing deck is provided which includes a fifty two card standard deck plus four jokers, thereby permitting as many as eight card-receiving players to participate. The jokers may either be wild, or may be used as aces, in straights, or in flushes.

In accordance with another preferred embodiment of the invention, a set of three special dice is provided which include representations of the numbers zero (blank), one, two, and four such that, when rolled, the total numeric value of the three dice will be one of the numbers one through 8 with each number being equally probable. The set of three special dice are used to determine an action player, and can also be used to determine the direction of sequential play of the game.

In accordance with an important feature of the invention, a player must have the better front hand and the better back hand, or have either the better front hand or the better back hand and tie the other hand in order to win the wager of the other player.

In accordance with an important aspect of the invention, the dealer deals a stack of seven cards for each player in such a manner that no stack receives two sequential cards.

In accordance with another important feature of the invention, if a player's hand includes more than one joker, at least one joker must be set in the front hand.

In accordance with a preferred embodiment of the invention, in an improved banking method the bank hand (player-banker) is not fixed throughout the hand, but rather the bank hand can move during the play of the game from player to player depending upon which player has the better hand.

In accordance with an important aspect of the invention, in the step of the comparing the action hand and the first sequential hand, if neither player wins the wager, the action hand becomes the bank hand and continues play.

In accordance with an important feature of the invention, in the step of comparing the bank hand and the next sequential hand, if neither player wins the wager, the bank hand continues play.

In accordance with another important aspect of the invention, in the step of comparing the bank hand and the next sequential hand, if one player has the better front hand and the other player has the better back hand, or if the players tie both the front and back hands, no wager is collected by either player, and the bank hand continues play.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
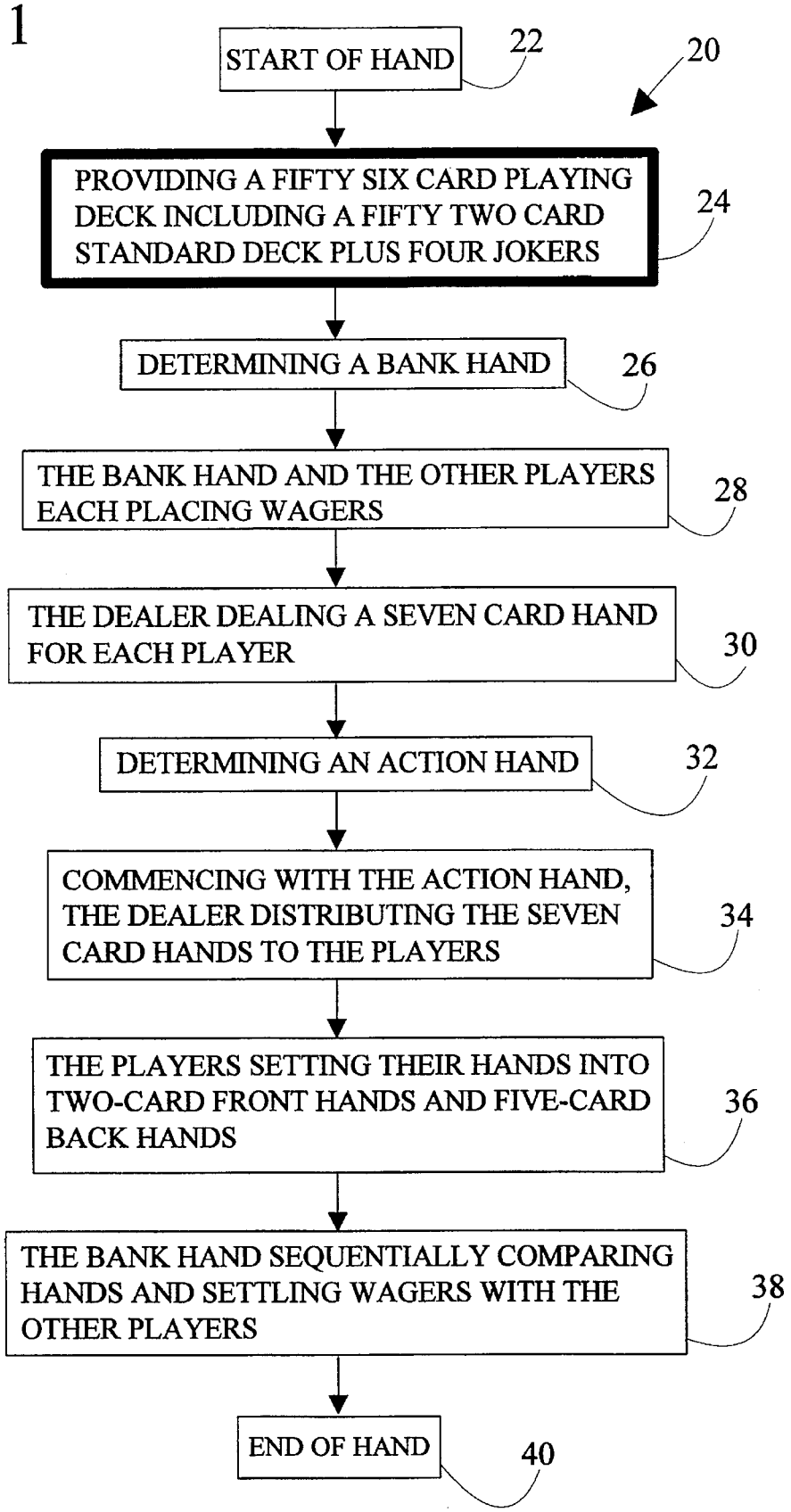
FIG. 1 is a flow diagram illustrating the steps and method of play of an improved version of the game of Pai Gow Poker in accordance with the present invention.
Figure 2:
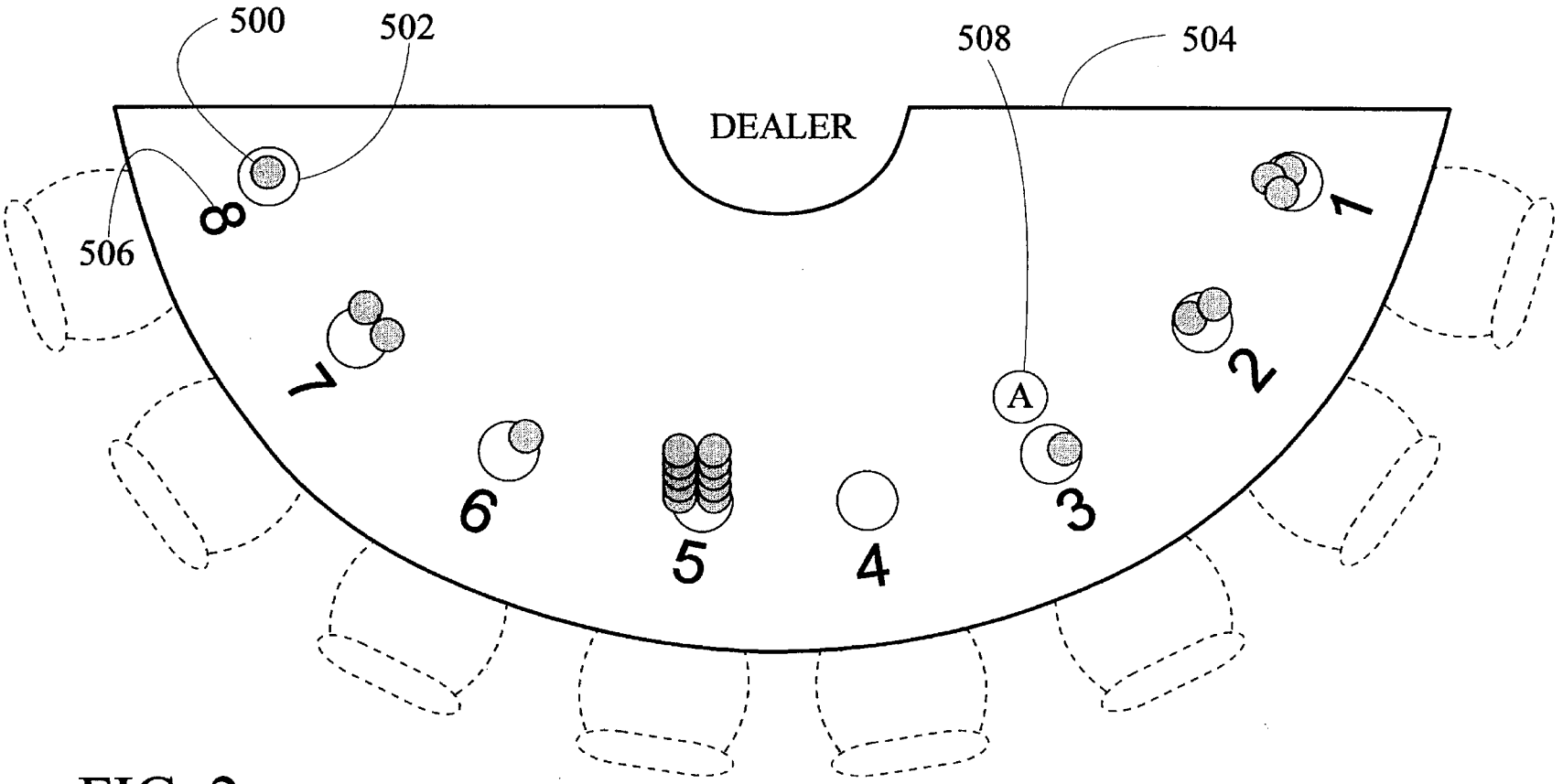
FIG. 2 is a plan view of a playing table layout.

Referring initially to FIGS. 1 and 2, there are depicted a flow diagram illustrating the steps and method of play and a plan view of a playing table layout, respectively, of an improved version of the game of Pai Gow Poker in accordance with the present invention, generally designated as 20. The improved game may include up to eight card-receiving players and a dealer, and is especially suited for play at a casino or other gaming establishment. It is noted that in all flow diagrams, the new or improved steps of the present invention are shown with heavy borders, whereas steps of the existing game of Pai Gow Poker are shown with light borders.

In FIG. 1, a hand begins with start terminator step 22. In step 24 a fifty six card playing deck is provided which includes a fifty two card standard deck plus four jokers. This is in contrast to the existing game of Pai Gow Poker in which only one joker is added to the standard fifty to card deck thereby resulting in a total of fifty three cards. In the present invention, by adding the three additional jokers, it is now possible to accommodate up to eight players with each receiving a seven card hand (as opposed to only seven in existing Pai Gow Poker). In the play of the present improved game, the four jokers (1) may either be wild, or (2) may be used as aces, in straights, or in flushes. The addition of the three jokers, on average, affords the players many more decision options in the setting of their hands, and will additionally result in better overall hands. In step 26 a bank hand (player-banker) is selected. In step 28 the bank hand and the other players each place wagers 500 in betting areas 502 directly in front of them on playing table 504 as shown in FIG. 2. The playing table 504 includes numbered playing positions 506 ranging from one to eight. Indicia depicting the betting areas 502, playing positions 506, or other pertinent information can be disposed upon the surface of the playing table 504 or a covering thereof. Depending upon gaming establishment rules, wagers 500 may be of several types. In one embodiment the wager 500 may be a spread-limit wager 500 which may be for a maximum amount, a minimum amount, or one of a plurality of predetermined incremental values between the two. For example, $10 (minimum), or $15, or $20, or $25, or $30 (maximum). In another embodiment, the wager 500 may be for any amount between a maximum and a minimum. In another embodiment, the wager may be a no-limit wager 500. In another embodiment, the wagers 500 of all players are the same and equal a predetermined table limit. In another embodiment, the players are provided with a plurality of betting areas 502 and may place wagers 500 in each betting area. In FIG. 2, hand five has been designated the bank hand. In that the players play against the bank hand, the wager 500 of the bank hand will normally be much greater than the wagers of the other players, and in fact will usually be equal to the sum of the wagers 500 of all the other players. This is called "covering the table". If the wager 500 of the bank hand is less than the sum of the wagers of the other players, it is possible that some of the players will not have their wagers resolved ("get action") during the course of the hand. Additionally, in another embodiment of wagering step 28, the bank hand and other players each contribute a predetermined collection amount to the dealer. This collection constitutes payment to the gaming establishment for the cost and profit of conducting the game.

In step 30 the dealer deals a seven card hand for each player. In step 32 an action hand (player) is determined, usually by the bank hand rolling three dice, and an action button 508 is placed in front of the action hand. In step 34, commencing with the action hand, the dealer distributes the seven card hands to the players. In step 36 the players set their hands into two-card front hands and five-card back hands. In step 38, commencing with the action hand, the bank hand sequentially compares hands and settles wagers 500 with the other players. The sequential comparison and settling continues until either all players have participated, or until the bank hand has lost all of his/her wager 500, and the game proceeds to end terminator step 40.

Figure 3:
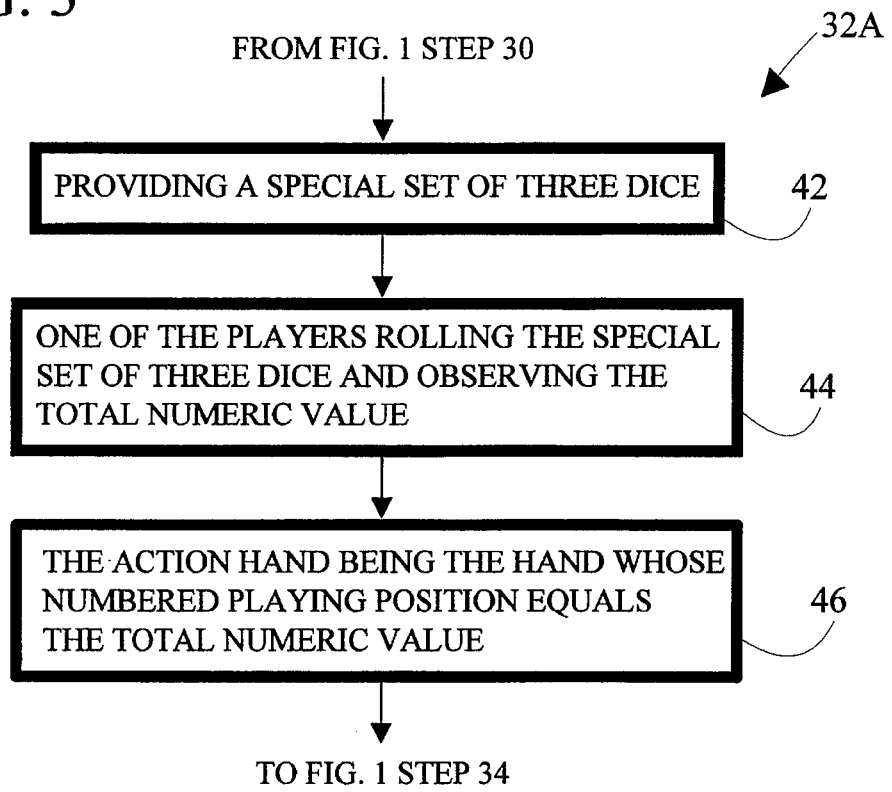
FIG. 3 is a flow diagram illustrating the steps and method of play of an improved method of selecting an action hand.
Figure 4:
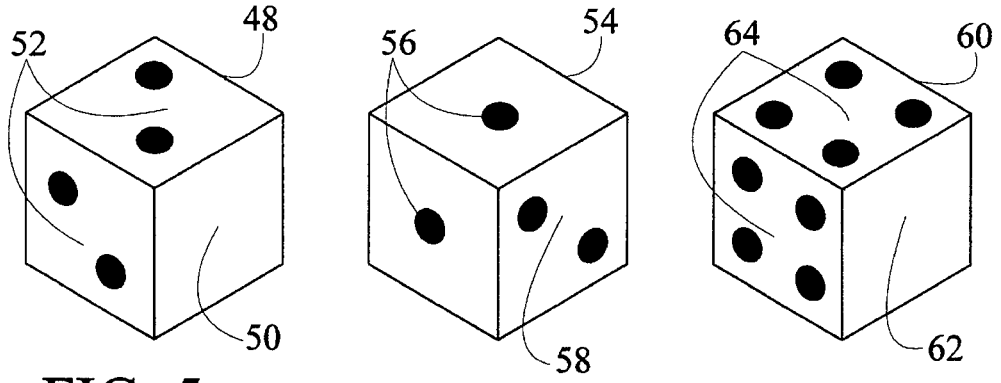
FIG. 4 is a perspective front view of a set of three special dice.
Figure 5:
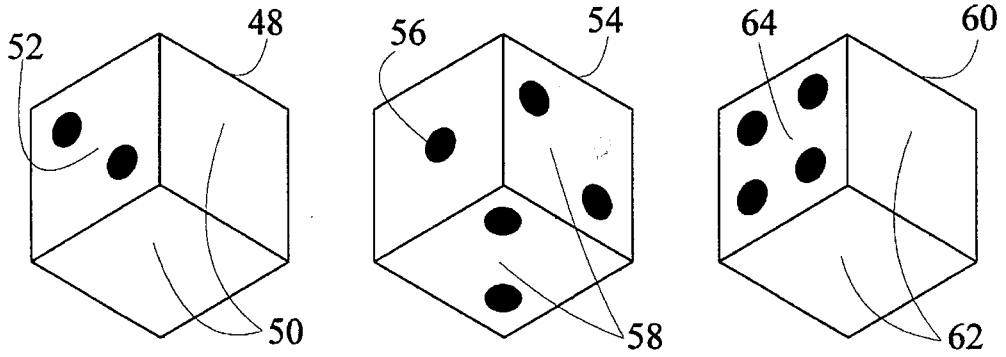
FIG. 5 is a perspective back view of the set of three special dice of FIG. 4.

FIG. 3 is a flow diagram illustrating the steps and method of play of an improved method of determining an action hand (step 32 of FIG. 1), generally designated as 32A, and FIGS. 4 and 5 are front and back perspective views respectively of a set of three special dice. In step 42 a set of three special dice is provided. The three special dice include a first die 48 having three blank (zero) sides 50 and three sides marked with a representation of the number two 52, a second die 54 having three sides marked with a representation of the number one 56 and three sides marked with a representation of the number two 58, and a third die 60 having three blank sides 62 and three sides marked with a representation of the number four 64. When the three special dice are rolled, the total numeric value of the three dice may range from one to eight, with an equal 0.125 probability that any one number will appear. This gives each numbered playing position an identical chance to becoming the action hand. Additionally, the three special dice are simpler to understand in that the total numeric value of the dice ranges from one through eight and exactly designates the action hand. Conversely, in the existing game of Pai Gow Poker, the total numeric value of the dice ranges from 3 through 18, and the location of the action hand must be computed. In step 44, the one of the players (for example, the last winner of the previous hand (deal)) rolls the three special dice and the total numeric value of the three dice is observed. The action hand is then the hand whose numbered playing position 506 equals the total numeric value of the three special dice. It may be appreciated that objects other than dice could be used to accomplish the action hand selection. For example, three coins could be used with a first coin having a blank on one side and a two on the opposite side, a second coin having a one on one side and a two on the opposite side, and a third coin having a blank on one side and a four on the opposite side. Other random methods of determining the action hand could include spinning pointers, numbered tokens drawn from a container, and the like. In another embodiment, the action hand simply rotates sequentially around the table with each new deal.

Figure 6:
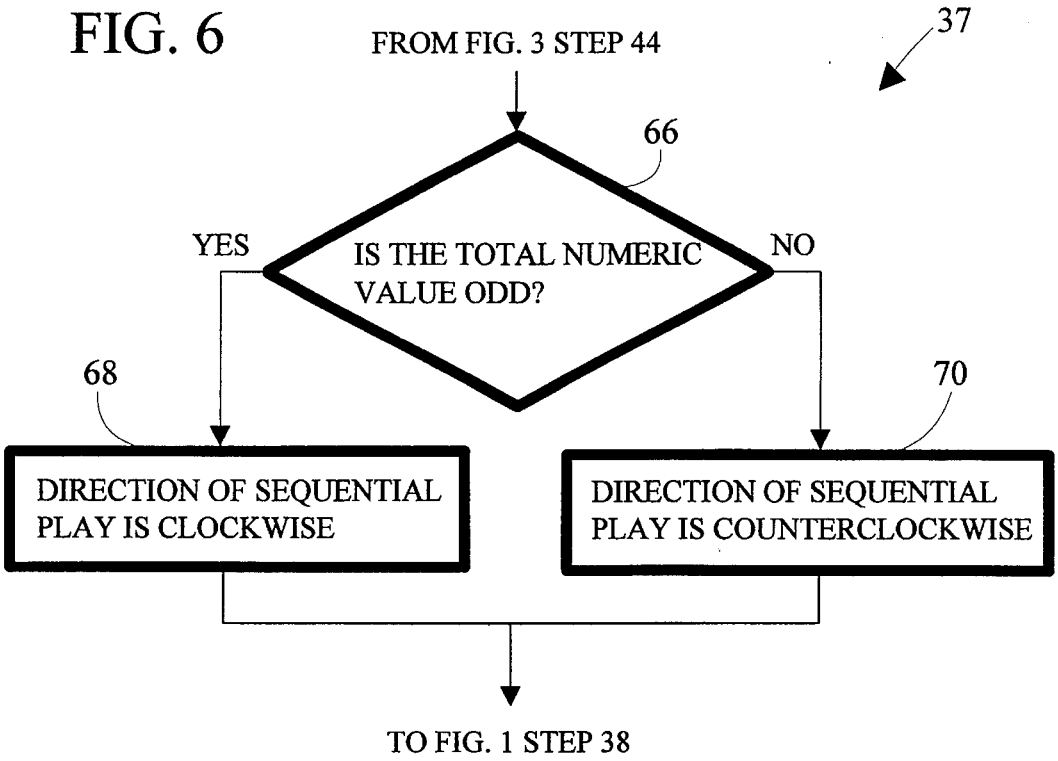
FIG. 6 is a flow diagram illustrating the steps and method of play of an improved method of determining the direction of play.

FIG. 6 is a flow diagram illustrating the steps and method of play of an improved method of determining the direction of sequential play (prior to step 38 of FIG. 1), generally designated as 37. In step 44 of FIG. 3, the total numeric value of the three dice is observed. In step 66 it is observed whether the total numeric value of the three special dice is odd. If the total numeric value is odd (yes), then in step 68 the direction of sequential play of step 38 of FIG. 1 proceeds clockwise, and if the total numeric value is even (no), then in step 70 the direction of sequential play of step 38 of FIG. 1 proceeds counterclockwise. It may be appreciated that the reverse could also be employed wherein odd results in counterclockwise play and even results in clockwise play. By employing this randomized playing direction approach, for a full playing table, any positional playing advantage is removed.

Figure 7:
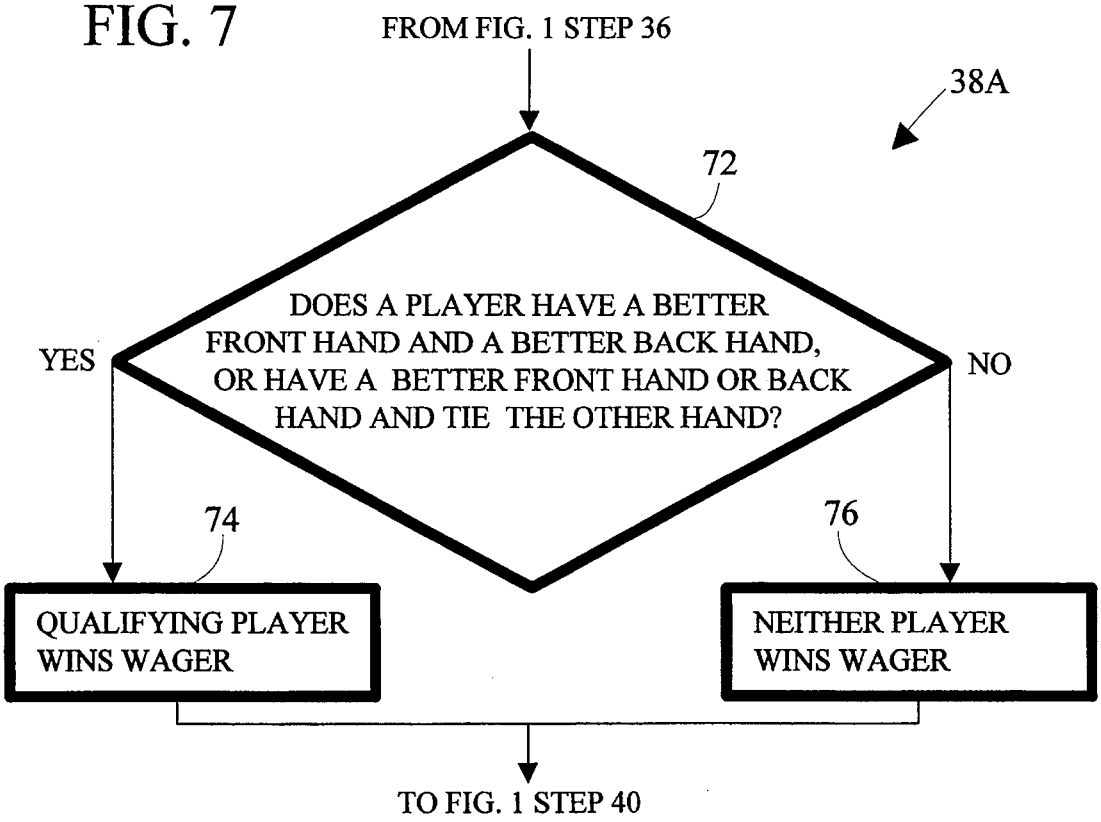
FIG. 7 is a flow diagram illustrating the steps and method of play of an improved method of settling wagers.

FIG. 7 is a flow diagram illustrating the steps and method of play of an improved method of settling wagers (step 38 of FIG. 1), generally designated 38A. In step 72 it is determined if (1) a player (bank hand, action hand, or other contending player) has either a better front hand and a better back hand, or (2) has either a better front hand or a better back hand and ties the other hand. If the answer in step 72 is yes, then in step 74 the qualifying player wins the wager of the other player. If the answer in step 72 is no, then in step 76 neither player wins the wager. It is noted that in the existing game of Pai Gow Poker, if the bank hand ties one hand and loses the other hand the wager is a push (tie), and the bank hand continues play. Conversely, in the present invention under the same circumstances, the bank hand would lose the wager and the winning player would become the bank hand.

Figure 10:
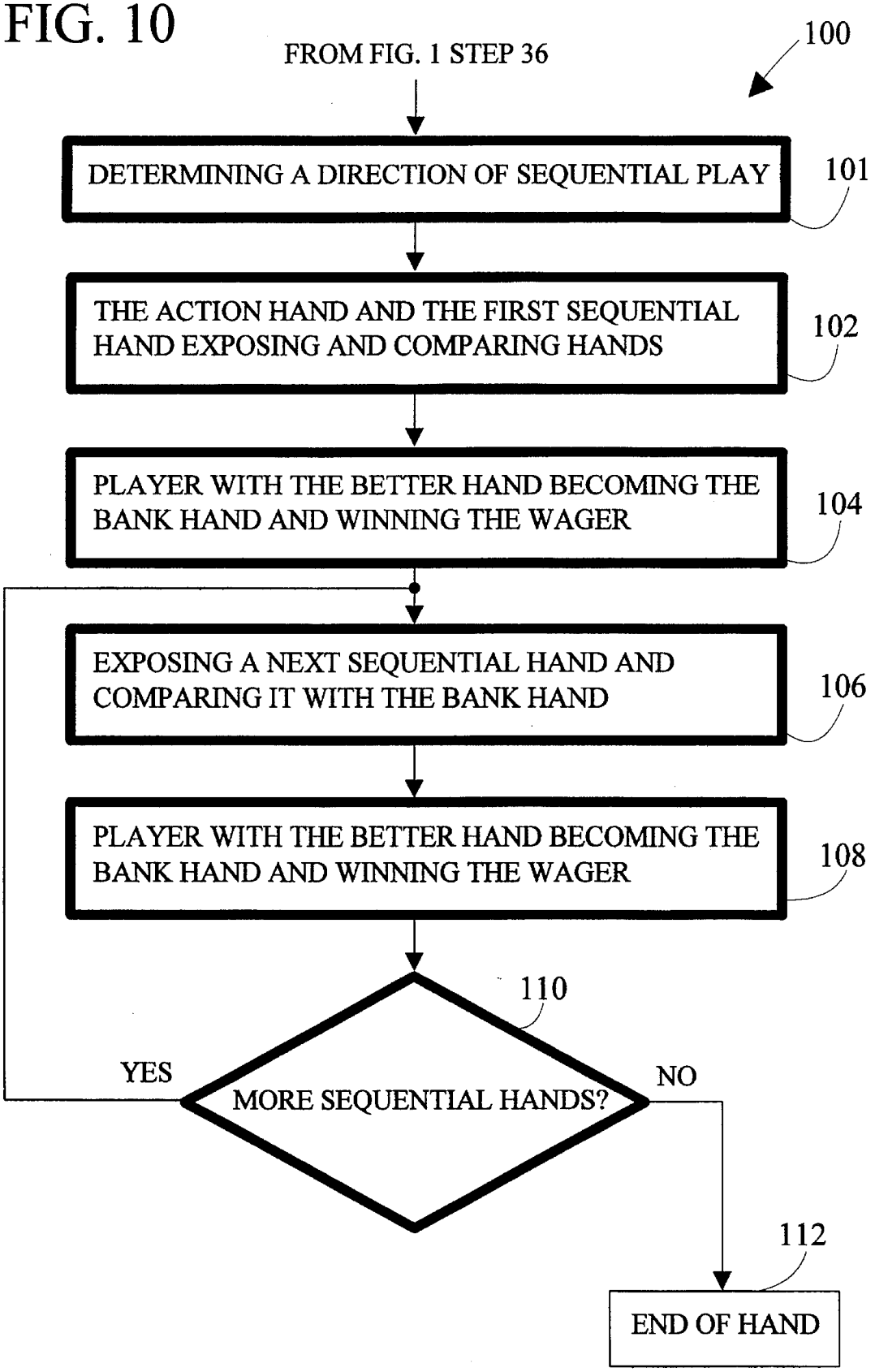
FIG. 10 is a flow diagram illustrating the steps and method of play of an improved method of banking.

This improved method of settling wagers lessens the advantage of the bank hand (player-banker) and is most effectively employed to even the odds when using the improved banking method of FIG. 10. The use of this improved method of settling wagers can be used with conventional Pai Gow Poker banking, however lessening the advantage of the bank hand in this instance is much less desirable.

Figure 8:
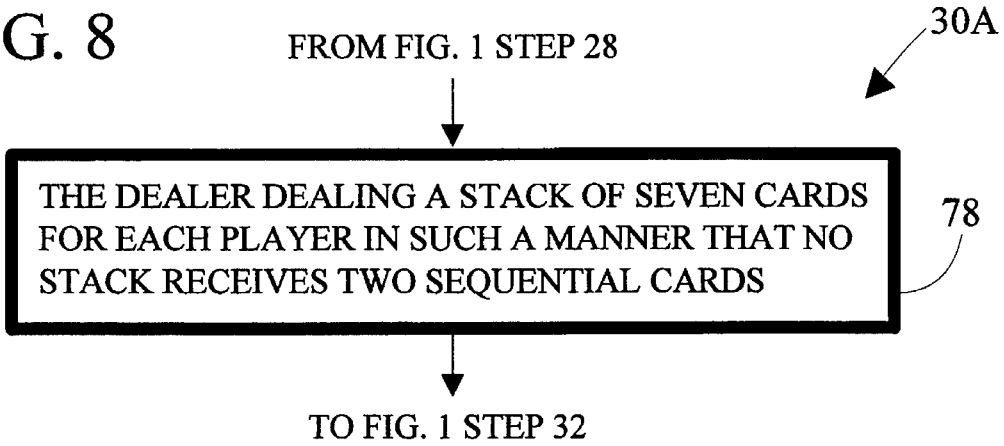
FIG. 8. is a flow diagram illustrating the steps and method of play of an improved method of dealing seven card hands for each player.

FIG. 8 is a flow diagram illustrating the steps and method of play of an improved method of dealing seven card hands for each player (step 30 of FIG. 1), generally designated as 30A. In step 78 the dealer deals a stack of seven cards for each player, doing so in such a manner that no stack receives two sequential cards. For example, in an eight handed game, the dealer would deal a first card sequentially to hands one through eight, and then would repeat the same process for cards two through seven. Alternatively, the dealer would deal a first card to hands one through four and then to hands eight through five, and then would repeat the same process for cards two through seven. This is in contrast to the typical method of dealing the cards in the existing game of Pai Gow Poker in which the dealer deals a first card sequentially to hands one through seven, and then deals a second card to hands seven through one, a third card to hands one through seven, etc. In this existing process, the end hands (one and seven) receive two sequential cards. This is undesirable in that if the playing cards are poorly shuffled, there exists a greater chance that two sequential cards will be a pair.

Figure 9:
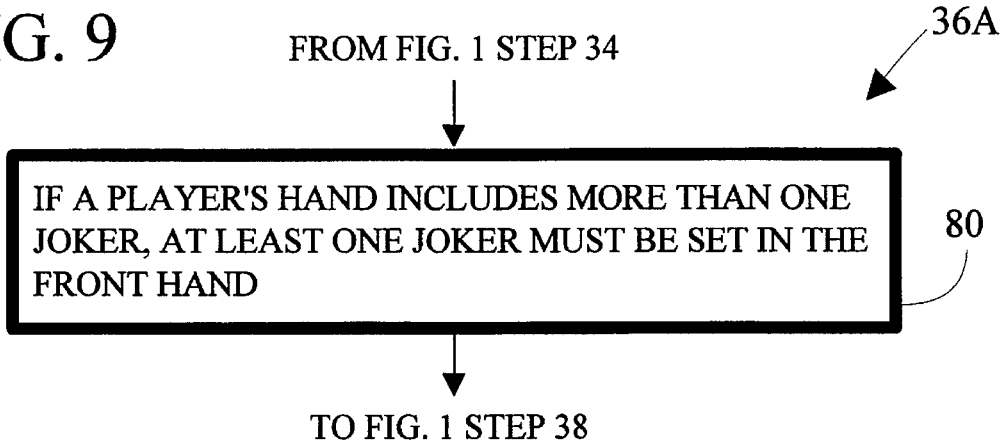
FIG. 9 is a flow diagram illustrating the steps and method of play of an improved method of the players setting their hands into two-card front hands and five-card back hands.

FIG. 9 is a flow diagram illustrating the steps and method of play of an improved method of the players setting their hands into two-card front hands and five-card back hands (step 36 of FIG. 1), generally designated as 36A. In step 80, if a player's seven card hand includes more than one joker, at least one joker must be set in the front hand. This feature can serve as a guide to new players unfamiliar with Pai Gow Poker by providing a usually effective playing policy. However, in other instances this feature will not be used thereby removing restrictions and permitting more playing flexibility.

FIG. 10 is a flow diagram illustrating the steps and method of play of an improved method of banking, generally designated as 100. In this embodiment the bank hand (player-banker) is not fixed throughout the hand, but rather the bank hand can move during the play of the game from player to player depending upon which player has the better hand. If a player wins the wager, he or she becomes the bank hand for the next exposure and comparison of hands. The playing table layout for this banking embodiment is similar to that of the existing game of Pai Gow Poker shown in FIG. 2, with the exception that the bank hand (playing position 5) will no longer have to make a wager(s) 500 that is substantially larger than those of the other players. Also of great importance, since the bank hand transfers to the player with the better hand, every player will "get action" every hand.

Prior to implementing the improved banking method, existing Pai Gow Poker steps 22 through 24 and 28 through 36 of FIG. 1 are performed. It is noted that for the improved banking method, in FIG. 1 improved step 24 of providing a fifty-six card playing deck is performed, and that existing step 26 of determining a bank hand is not performed. In step 101 a direction of sequential play is determined. The direction of sequential play may be selected by a variety of means. For example, the direction of sequential play may simply be clockwise which is preferred, or counterclockwise. In another embodiment, the direction of sequential play is determined by the total numeric value of the set of three special dice being odd or even (refer to FIGS. 3 through 6 and the accompanying textual discussion). In yet another embodiment, the direction of sequential play is initially clockwise for exposing and comparing the action hand and the first sequential hand, but can change to counterclockwise for remaining play, depending upon which of the action hand or first sequential hand wins the wager. It is appreciated that numerous other methods could also be employed to determine the direction of sequential play. For example, in the initial exposure and comparison, which player wins the front hand, the back hand, etc.

In step 102 the action hand (player) and the first sequential hand (player) expose (open) and compare hands in a direction of sequential play. In step 104, of the two contending players, the player with the better hand (winner) wins the wager 500 of the other player (loser), the winner becoming the initial bank hand. In subsequent play, the player who is the bank hand remains the bank hand until such time as he/she loses to another player, at which time the new winner becomes the bank hand and continues play. In step 104, if neither player wins the wager, the action hand becomes the bank hand and continues to play. In step 106 the next sequential hand exposes his/her hand and it is compared with the bank hand. In step 108, of the two contending players, the player with the better hand (winner) wins the wager 500 of the other player (loser), the winner becoming (remaining if the current bank hand wins) the bank hand. In step 108, if neither player wins the wager, the bank hand continues to play. In step 110, if there are more sequential hands (yes), steps 106, 108, and 110 are repeated until all players have participated. In step 110, if there are no more sequential hands (no), the game proceeds to end terminator step 112 and the hand is concluded.

In a preferred embodiment of the improved banking method, a player must have the better front hand and the better back hand, or have either the better front hand or the better back hand and tie the other hand in order to win the wager. In another preferred embodiment of the improved banking method, in comparing the bank hand and the next sequential hand, if one player has the better front hand and the other player has the better back hand, or if the players tie both the front hand and the back hand, no wager is collected by either player, and the bank hand continues play.

It is further appreciated that any or all of the features previously addressed in the discussion of FIGS. 3 through 9 could also be applied to the play of an improved version of Pai Gow Poker which utilizes the present improved banking method. The same is true of the utilization of the jokers as either wild or as aces, in straights, or in flushes.

Figure 11:
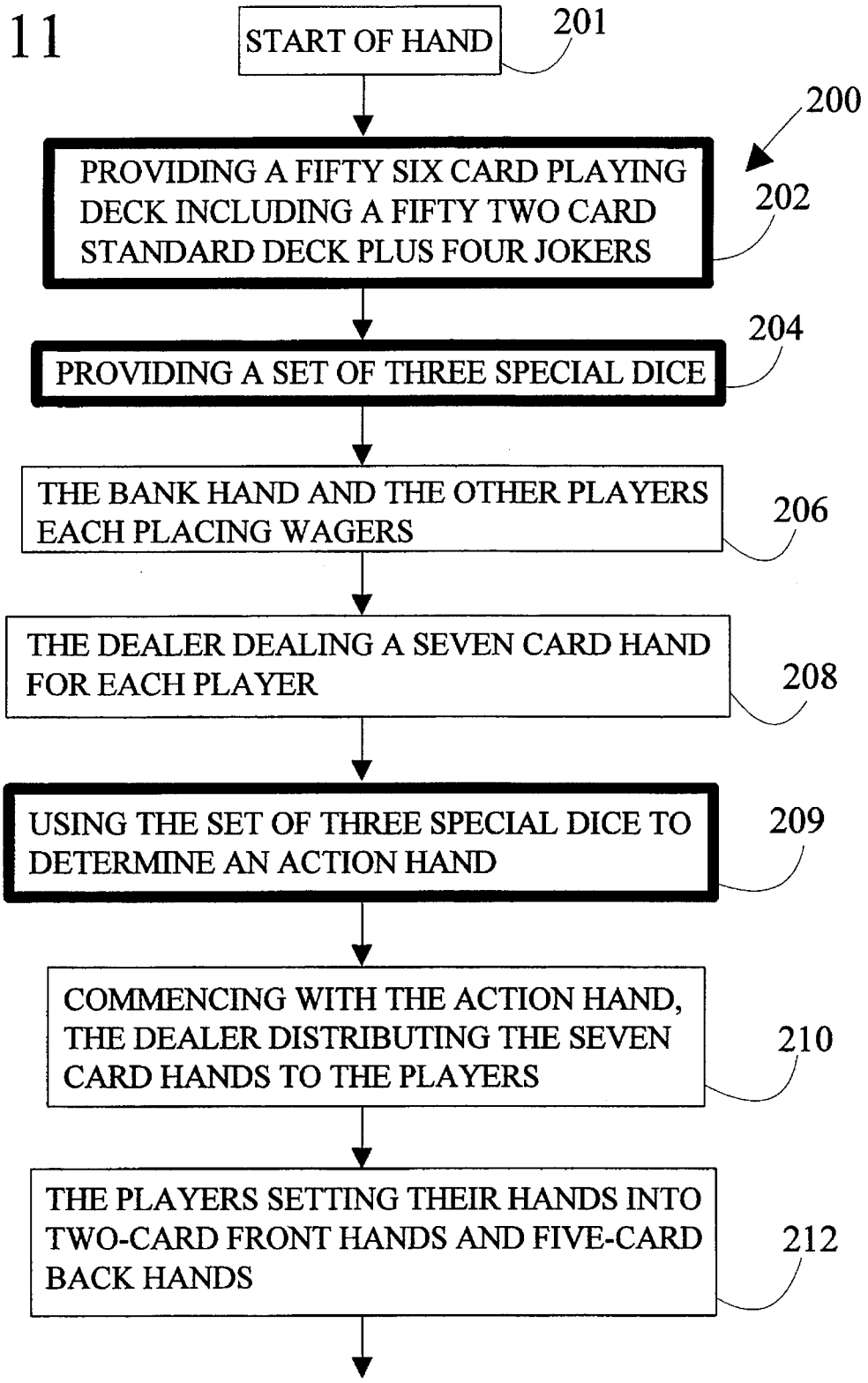
FIG. 11 is a flow diagram illustrating the steps and method of play of an improved version of the game of Pai Gow Poker which incorporates the improvements of a fifty-six card playing deck, a set of three special dice, and an improved method of banking.
Figure 11:
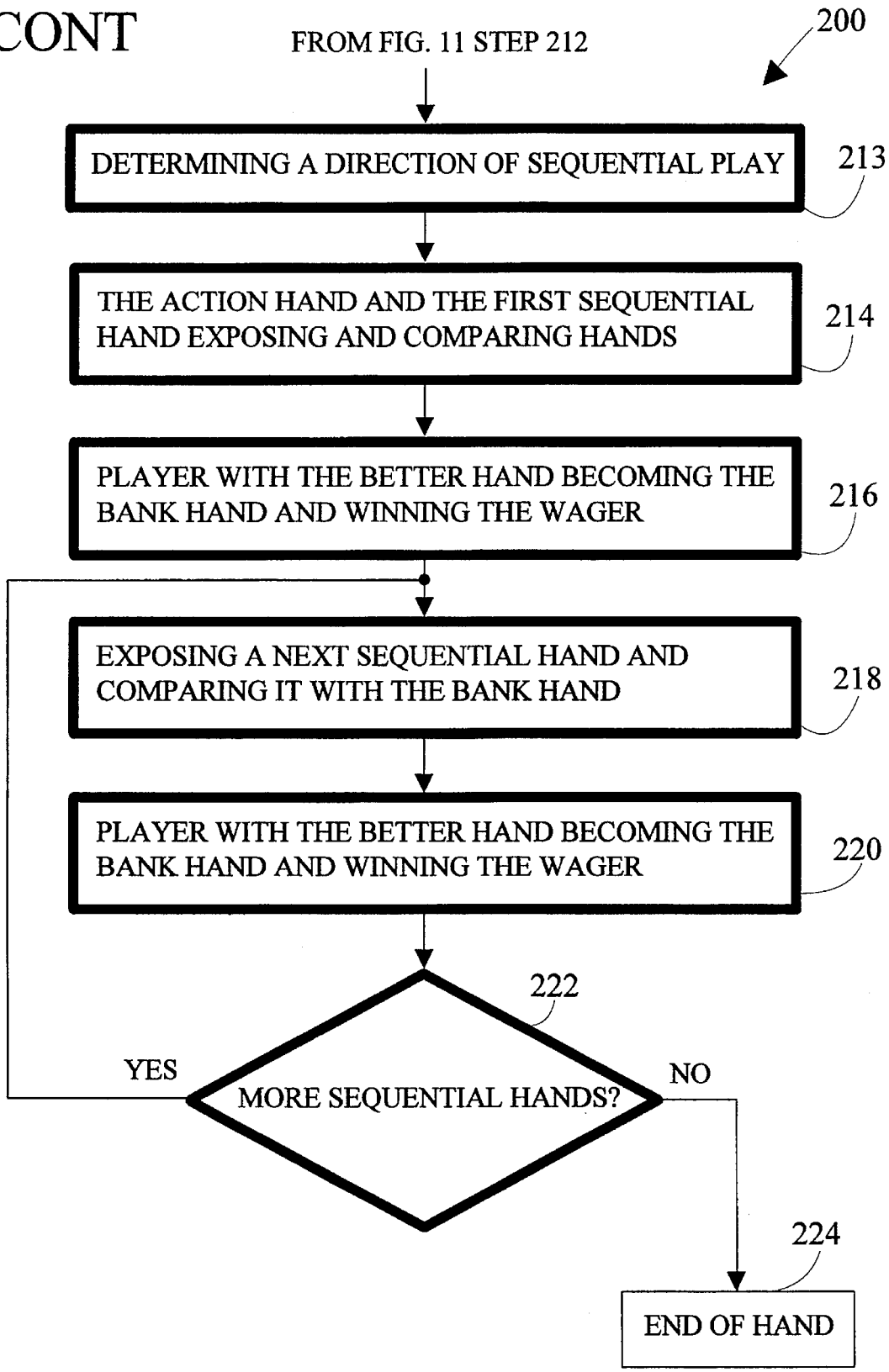

FIG. 11 is a flow diagram illustrating the steps and method of play of an improved version of the game of Pai Gow Poker which incorporates the improvements of a fifty-six card playing deck, a set of three special dice, and an improved method of banking, generally designated as 200.24. It is noted that in FIG. 11, the improved steps are shown with heavy borders. A hand begins with start terminator step 201. In step 202, a fifty six card playing deck is provided which includes a fifty two card standard deck plus four jokers, thereby permitting as many as eight players to participate in the game. In step 204, a set of three special dice are provided which include representations of the numbers zero, one, two, and four such that, when rolled, the total numeric value of the three dice will be one of the numbers one through 8 with each number being equally probable (refer also to the discussions of FIGS. 3, 4, and 5). Devices other than dice such as coins could also be utilized to result in a random selection of a number between one and eight. In step 206 each of the players place wagers. In step 208, a dealer deals a seven card hand for each player. In step 209, the set of three special dice are then rolled by one of the players (for example the last winner of the previous hand) to determine an action hand. In step 210, commencing with the action hand, the dealer distributes the seven card hands to the players. In step 212, the players set their hands into two-card front hands and five-card back hands. In step 213 a direction of sequential play is determined (refer to step 101 of FIG. 10) In step 214, the action hand and a first sequential hand expose (open) and compare hands; In step 216, the player with the better hand becomes the bank hand and wins the wager of the other player. In step 218 a next sequential hand is exposed and compared with the bank hand. In step 220, the player with the better hand becomes (remains if the current bank hand wins) the bank hand and wins the wager of the other player. In step 222, if there are more sequential hands (yes), steps 218, 220, and 222 are repeated until all players have participated. In step 222, if there are no more sequential players (no), the game proceeds to end terminator step 224 and the hand is ended.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. An improved method of playing the existing game of Pai Gow Poker, the existing game of Pai Gow Poker including the steps of:

determining a bank hand;

the bank hand and each of the other players placing wagers;

a dealer dealing a seven card hand for each player;

determining an action hand;

the dealer distributing the seven card hands to the players;

the players setting their hands into two-card front hands and five-card back hands; and, the bank hand sequentially comparing hands and settling wagers with the other players, the improvement comprising:

providing a fifty six card playing deck including a fifty two card standard deck plus four jokers, thereby permitting as many as eight players to participate in the game;

providing a set of three special dice to be utilized in the step of determining an action hand, said set of three special dice further including a first die having three blank sides and three sides marked with a representation of the number two, a second die having three sides marked with a representation of the number one and three sides marked with a representation of the number two, and a third die having three blank sides and three sides marked with a representation of the number four; and, in the step of determining an action hand, each player having a numbered playing position ranging from one to eight, one of the players rolling said set of three dice, the total numeric value of said three dice ranging from one to eight, the action hand being the hand whose numbered playing position equals said total numeric value of said three dice.

2. The method according to claim 1, wherein said four jokers are wild.

3. The method according to claim 1, wherein said four jokers may be used as aces, in straights, or in flushes.

4. The method according to claim 1, wherein the step of the bank hand sequentially comparing hands and settling wagers with the other players proceeds in a direction of sequential play, said direction being clockwise if said total numeric value is one of odd and even, and said direction being counterclockwise if said total numeric value is the other of odd and even.

5. The method according to claim 1, said improvement further including wherein in the step of the bank hand sequentially comparing hands and settling wagers with the other players, a player must have the better front hand and the better back hand, or have either the better front hand or the better back hand and tie the other hand in order to win the wager.

6. The method according to claim 1, in the step of a dealer dealing a seven card hand for each player, said improvement further including the dealer dealing a stack of seven cards for each player in such a manner that no said stack receives two sequential cards.

7. The method according to claim 1, wherein the step of determining a bank hand occurs after the step of determining an action hand, said improvement further including the steps of:

determining a direction of sequential play;

the action hand and a first sequential hand exposing and comparing hands;

the player with the better hand becoming the bank hand and winning the wager of the other player;

exposing a next sequential hand and comparing it with the bank hand;

the player with the better hand becoming the bank hand and winning the wager of the other player; and, repeating said steps of exposing said next sequential hand and comparing it with the bank hand, and the player with the better hand becoming the bank hand and winning the wager of the other player, until all players have participated.

8. The method according to claim 7, wherein said four jokers are wild.

9. The method according to claim 7, wherein said four jokers may be used as aces, in straights, or in flushes.

10. The method according to claim 7, wherein said direction of sequential play is clockwise if said total numeric value is one of odd and even, and said direction of sequential play is counterclockwise if said total is the other of odd and even.

11. The method according to claim 7, further including the step of:

in said steps of the player with the better hand becoming the bank hand and winning the wager of the other player, a player must have the better front hand and the better back hand, or have either the better front hand or the better back hand and tie the other hand in order to win the wager.

12. The method according to claim 11, wherein in said step of comparing the action hand and the first sequential hand, if neither player wins the wager, the action hand becomes the bank hand and continues play.

13. The method according to claim 11, wherein in said step of comparing the bank hand and the next sequential hand, if neither player wins the wager, the bank hand continues play.

14. The method according to claim 7, wherein in said step of comparing the bank hand and the next sequential hand, if one player has the better front hand and the other player has the better back hand, or if the players tie both front and back hands, no wager is collected by either player, and the bank hand continues play.

15. The method according to claim 7, the step of a dealer dealing a seven card hand for each player further including the dealer dealing a stack of seven cards for each player in such a manner that no said stack receives two sequential cards.

16. The method according to claim 7, wherein in the step of the players setting their hands into two-card front hands and five-card back hands, if a player's hand includes more than one said joker, at least one said joker must be set in the front hand.

17. An improved method of playing the existing game of Pai Gow Poker, the existing game of Pai Gow Poker including the steps of:

determining a direction of sequential play;

each of the players placing a wager;

a dealer dealing a seven card hand for each player;

determining an action hand;

distributing the seven card hands to the players;

the players setting their hands into two-card front hands and five-card back hands; the improvement comprising:

providing a fifty six card playing deck including a fifty two card standard deck plus four jokers, thereby permitting as many as eight players to participate in the game; and, in the step of the players setting their hands into two-card front hands and five-card back hands, if a player's hand includes more than one said joker, at least one said joker must be set in the front hand.

18. An improved method of playing the existing game of Pai Gow Poker, the existing game of Pai Gow Poker including the steps of:

determining a direction of sequential play;

each of the players placing a wager;

a dealer dealing a seven card hand for each player;

determining an action hand;

distributing the seven card hands to the players;

the players setting their hands into two-card front hands and five-card back hands; the improvement comprising:

providing a fifty six card playing deck including a fifty two card standard deck plus four jokers, thereby permitting as many as eight players to participate in the game;

the action hand and a first sequential hand exposing and comparing hands;

the player with the better hand becoming a bank hand and winning the wager of the other player;

exposing a next sequential hand and comparing it with the bank hand;

the player with the better hand becoming the bank hand and winning the wager of the other player; and, repeating said steps of exposing said next sequential hand and comparing it with the bank hand, and the player with the better hand becoming the bank hand and winning the wager of the other player, until all players have participated.

* * * * *